United States Patent [19]

Schiffer

[11] 4,455,845

[45] Jun. 26, 1984

[54] APPARATUS FOR FORMING PATTERNS IN MATERIALS SUCH AS TEXTILE GOODS

[75] Inventor: Günter Schiffer, Krefeld, Fed. Rep. of Germany

[73] Assignee: Eduard Kusters Maschinenfabrik, Krefeld, Fed. Rep. of Germany

[21] Appl. No.: 345,763

[22] Filed: Feb. 4, 1982

[30] Foreign Application Priority Data

Feb. 5, 1981 [DE] Fed. Rep. of Germany ..... 3103894

[51] Int. Cl.[3] ..... D06B 1/10

[52] U.S. Cl. ..... 68/204; 118/257

[58] Field of Search ..... 68/200, 202, 203, 204, 68/205 R, 45; 118/257, 411, 412; 101/364, 365; 8/149.1, 477

[56] References Cited

U.S. PATENT DOCUMENTS

| | | | |
|---|---|---|---|
| 397,091 | 1/1889 | Mortimer | 101/365 X |
| 596,905 | 1/1898 | McCoy | 68/205 R X |
| 3,654,781 | 4/1972 | Plechac | 68/45 X |
| 3,969,780 | 7/1976 | Henderson | 8/149.1 |
| 4,349,930 | 9/1982 | Van Wersch et al. | 68/204 X |
| 4,375,158 | 3/1983 | Eichmanns et al. | 68/205 R |
| 4,384,867 | 5/1983 | Gruber | 8/149.1 X |

FOREIGN PATENT DOCUMENTS

| | | | |
|---|---|---|---|
| 2048289 | 4/1972 | Fed. Rep. of Germany | 68/45 |
| 2214377 | 10/1973 | Fed. Rep. of Germany . | |

*Primary Examiner*—Philip R. Coe

*Attorney, Agent, or Firm*—Burns, Doane, Swecker & Mathis

[57] ABSTRACT

A dye-containing foam is applied to a textile to create patterns thereon. The foam is transferred to the textile in the form of parallel lanes or strips. The lanes of foam are formed on an endless belt which then merges with the textile at a nip to effect the transfer of the dye. The lanes of foam are bordered by parallel partitions which are adjustable to vary the exiting width of the foam. A vertically adjustable doctor blade in each lane governs the height of each lane of foam. An agent for promoting the disintegration of the foam is applied to the side of the textile opposite the side to which the foam is applied, to assure a more uniform application of dye in the direction of the depth of the textile.

30 Claims, 2 Drawing Figures

II
1
1'
2
3
4
5
6
7
8
9
10
10'
11
12
13
13'
14
16
17
18
18'
18''
19
20
21
22
22A
23
25
26
27
28
29
30
31
32
33

1
3
10
7
4
29
30
6
31
1
24
10
30
13'
21
21
25
13'
18''
20
22
22
20
10'
19
18
19
20
20
20
22
19
18
19
18'
17
17
17
17
15
16
16
16
16
16
16
15
13
13
13
10
10
5
14
14
14

APPARATUS FOR FORMING PATTERNS IN MATERIALS SUCH AS TEXTILE GOODS

BACKGROUND AND OBJECTS OF THE INVENTION

The invention concerns a process and apparatus for dyeing textile goods.

A process and an apparatus of this type for the dyeing of widths of textile goods are known from U.S. Pat. No. 3,969,780. Here, the foam is uniformly applied over the width of the goods; it penetrates into the material, and the dye contained in the foam is fixed in the conventional manner. The metering of the dye is effected in that the applied foam layer is doctored off at a height that is constant transversely of the width of the fabric. This height may be adjusted with great accuracy so that the metering of the dye applied per surface unit of the fabric is highly accurate. Since, however, the application is effected uniformly over the width of the fabric, only single color dyeing is possible.

It has also been proposed in principle to obtain patterned dyeing of a width of fabric by the patterned application of different dye foams (DE-AS 22 14 377).

A machine for the patterning of wallpaper is known from U.S. Pat. No. 596,905, wherein a roll rotates in a dye trough extending transversely over and above the width of material. The roll is partially immersed in the trough during its rotation. A doctor blade is applied against a downwardly traveling side of the roll. The doctor blade rakes off the layer of liquid entrained on the surface of the roll, which then flows over the doctor blade obliquely inclined to the fabric and drops in a veil from the lower edge of the blade onto the fabric. In the trough, lanes are provided by means of partitions extending parallel to the direction of travel of the fabric and reaching the roll. The partitions are engaging a plurality of grooves in the roll. Each lane is associated with a feeder device, whereby different dye liquids may be fed into the individual lanes. The liquids are passed separately onto the blade but are intermixed in a predetermined manner during their further travel to the fabric. This device is not suitable for the transfer of foam; it is not possible to produce definite layers of foam in the individual lanes with such known apparatus.

In the process according to DE-AS No. 22 14 377 the means promoting the decomposition of the foam is either added immediately to the foam or it is subsequently sprayed onto the foam, or else applied flat in another manner to the foam. In both cases, the relatively small amount of the liquid containing the patterning agent is contacting initially the outer fibers, i.e., those located on the side of the application of the foam and these therefore necessarily are receiving a higher concentration of chemicals than fibers located at a greater depth, which are reached by the liquid only after it has given up a portion of its chemicals to the outer fibers. In this manner, a distribution that is uniform over the surface of the width of the fabric is obtained during the application of the patterning substance in the form of a foam, but not uniform over the depth of the fabric. In certain cases this may represent a disadvantage. The subsequent working of the foam or of the liquid formed by it into the fabric by suction, blowing or squeezing cannot correct this condition with the slight amount of the liquid offered, as shown by experimentation.

It is the object of the invention to provide a process and an apparatus whereby pattern dyeing of this type may actually be effected.

Another object is to enable layers of foam of definite preselected height to be formed and then applied to a textile.

A further object is to promote a greater degree of uniformity to dye application in the direction of the depth of a material being dyed.

SUMMARY OF PREFERRED EMBODIMENTS OF THE INVENTION

At least some of these objects are achieved by the present invention which involves a process and apparatus for applying patterns to a textile. The process involves forming a plurality of laterally spaced, longitudinally extending lanes of dye-containing foams having preselected depths. The textile is advanced longitudinally and is merged with those lanes of foam such that the lanes of foam are applied to one side of the textile.

The placing of foams in lanes adjacent to each other produces a striped pattern, which may be multi-colored when foams of different color are applied to the individual lanes, but which may also exhibit only a pattern within a certain color shade, possibly in the sense of different depths of shade.

Preferably, the width of the individual lanes may be varied in size to create different patterns.

The heights of the lanes of foam are mutually varied, to provide a further means of altering the pattern. An important fact is that patterning in this variant is effected additionally in the longitudinal direction of the applied stripes so that they no longer are of a uniform color or depth of shade or structure in the longitudinal direction. In an extreme case, this may be pursued until the longitudinal stripes are interrupted and the stripe pattern of the process according to the invention is converted into a pattern comprising essentially rectangular fields distributed over the surface of the width of fabric, which in the case of an adequate fineness of detail, i.e., sufficiently narrow lanes and an adequately high frequency of the variation of foam height or foam structure, may amount to an actual figuring of the fabric surface.

Preferably, the patterning of the textile is created by forming lanes of different foams.

Preferably, the lanes of foam are applied upon a traveling substrate, which substrate is thereafter merged with the textile.

Preferably, an agent which promotes the disintegration of the lanes of foam is applied to a side of the textile which is opposite the side to which the lanes of foam are applied.

One preferred apparatus for applying the patterns to the textile comprises a plurality of laterally spaced partitions extending in a longitudinal direction and forming a plurality of laterally adjacent lanes extending in a longitudinal direction. Means is provided for introducing dye-containing foams into the lanes. Means is provided for regulating the heights of foam in the lanes. Means is provided for moving the textile in the longitudinal direction and into engagement with the lanes of foam to transfer the foam to the textile.

The partitions are not absolutely necessary, but are preferably provided and made of sheet metal or thin synthetic plastic plates, which in the lateral direction extend only slightly, so that the foam layers adjacent to the two sides of a partition come into mutual contact and interaction immediately following the passing of the ends of the partitions. This interaction results in further variations of the pattern image.

Preferably, the partitions are adjustable to vary the widths of the downstream ends of the lanes. This makes it possible to pattern the width of fabric by varying the width of the individual lanes for the foam. The total number of lanes and the overall width covered by the entirety of lanes, which corresponds to the width of the fabric, naturally remain constant.

Preferably, the means for regulating the height of the layers of foam comprises a plurality of doctor blades. Each doctor blade extends between adjacent partitions and is adjustable to conform to the width of the associated lane.

The doctor blades obviously must be capable of covering the entire width of an individual lane. If the width of a lane is changed, it must be possible to adjust the working width of the blade accordingly.

Preferably, each blade can be bent in the direction of textile travel. Alternatively, the blades can be rotatable about axes extending perpendicular to the direction of travel. In the case of employing a flexible doctor blade, the blade may consist of a flexible strip of sheet metal or a synthetic plastic, bent elastically with their ends contacting the partitions. Their length and their elasticity is determined so that the installation may be retained over the entire range of lane width to be considered.

In the case of the doctor blades being pivotably mounted, the lane is adjusted to a narrower width, the blade is rotated somewhat from its transverse direction.

Preferably, the blades are adjustably movable toward and away from the lanes to adjust the foam heights. This makes it possible to regulate the amount of the dye being applied to the textile, and thereby controlling, for example, the shade of the color being applied.

Preferably, means is provided for introducing additional substances into the lanes downstream of the blades. This enables further variations of the pattern to be obtained since additional dyes may be applied to a uniform layer of foam, yielding a regularly patterned background in the individual lanes, with said additional dyes interacting with the first layer of foam, thereby varying the pattern image of individual lanes.

It is possible in principle to arrange the partitions forming the lanes directly over the width of textile itself, so that the foam is deposited directly upon the textile. This, however, may lead to problems because the patterning means, for example the foam of the dye liquid, contacts the fabric during the formation of the foam layer imparting the pattern, possibly resulting in undesirable and random irregularities.

For this reason, it is preferable to employ a separate substrate merging with the fabric following the formation of the completely patterned foam layer. Whatever is applied to a certain location on the fabric is thereby accurately defined and the traveling width of the fabric cannot absorb, as in the case of the direction application of the foam, different amounts of the patterning means as a function of its locally different structure and absorptivity. The substrate preferably comprises a belt which in a sense by way of analogy, performs the function of an offset web in an offset printing process.

Preferably, the endless belt comprises a soft, thick-walled material having a sealed surface. Such a belt provides a particularly effective "massaging" of the foam into the fabric.

In the case where the application force provided by the tension of the belt against the fabric is not sufficient, the force may be reinforced by a plurality of pressure rolls pressing the belts toward a traversing roll.

The traveling width of fabric is in contact for a predetermined period of time with the endless belt at a given advance velocity of the fabric. During this period of time the transfer of the foam and the patterning means contained therein to the fabric must be effected. This process represents a transport process and is therefore time dependent. It may be desirable to adjust the contact time to the working rate desired, the structure of the fabric and of the foams applied. To achieve this adjustment, at least one of the support rolls for the belt can be adjustable to vary the extent of the curved portion along which the textile is in contact with the traversing roll. The displacement of the support roll is most readily effected if it is supported pivotingly on swiveling levers.

The invention is the result of efforts to further develop the technology of the dyeing of traveling widths of textiles, in particular carpets. It is, however, not restricted to the latter. It is specifically the form of application of the patterning means as a foam that renders possible the uniform application of particularly small amounts of a dye per unit surface; this makes the process suitable for the patterning of goods such as thin textiles, fleece, paper, etc. However, the process is not restricted to the patterning of absorbent substrates, but is suitable in principle for goods with sealed surfaces.

Dyeing is the primary process of patterning. But it is also possible to apply patterns which are revealed in colors indirectly only, i.e., resists which become visible after a subsequent single color dyeing. In place of dye patterns, structural patterns may be applied to be recognized by the surface configuration of the substrate, or patterns which alter by zones for example the handle of textile goods. Such resists are intended to be covered by the term "dye" used herein.

The present invention also relates to a process of the type wherein a dye-containing foam is applied to one side of a sheet of material, such as a textile, and thereafter an agent is applied to promote the disintegration of foam. In accordance with the present invention, the disintegration-promoting agent is applied to the side of the sheet opposite the side to which the foam is applied.

In this manner, the entire amount of liquid contained in the foam is not released at once but only gradually by the contact of the foam front with the agent inside the fabric or on its surface. The intensity of the action of the patterning material is thereby rendered uniform over the depth of the fabric. This concept may be effected generally in the dyeing of traveling widths of fabric, i.e., independently of the specific processes and associated apparatus described hereinabove.

THE DRAWING

In the drawing, an example of embodiment of the invention is show schematically wherein:

FIG. 1 shows a lateral elevation of an installation according to the invention; and FIG. 2 shows a view according to FIG. 1 from the top, wherein the width of fabric is cut away on the left-hand side.

DETAILED DESCRIPTION OF A PREFERRED EMBODIMENT OF THE INVENTION

Figure 1:
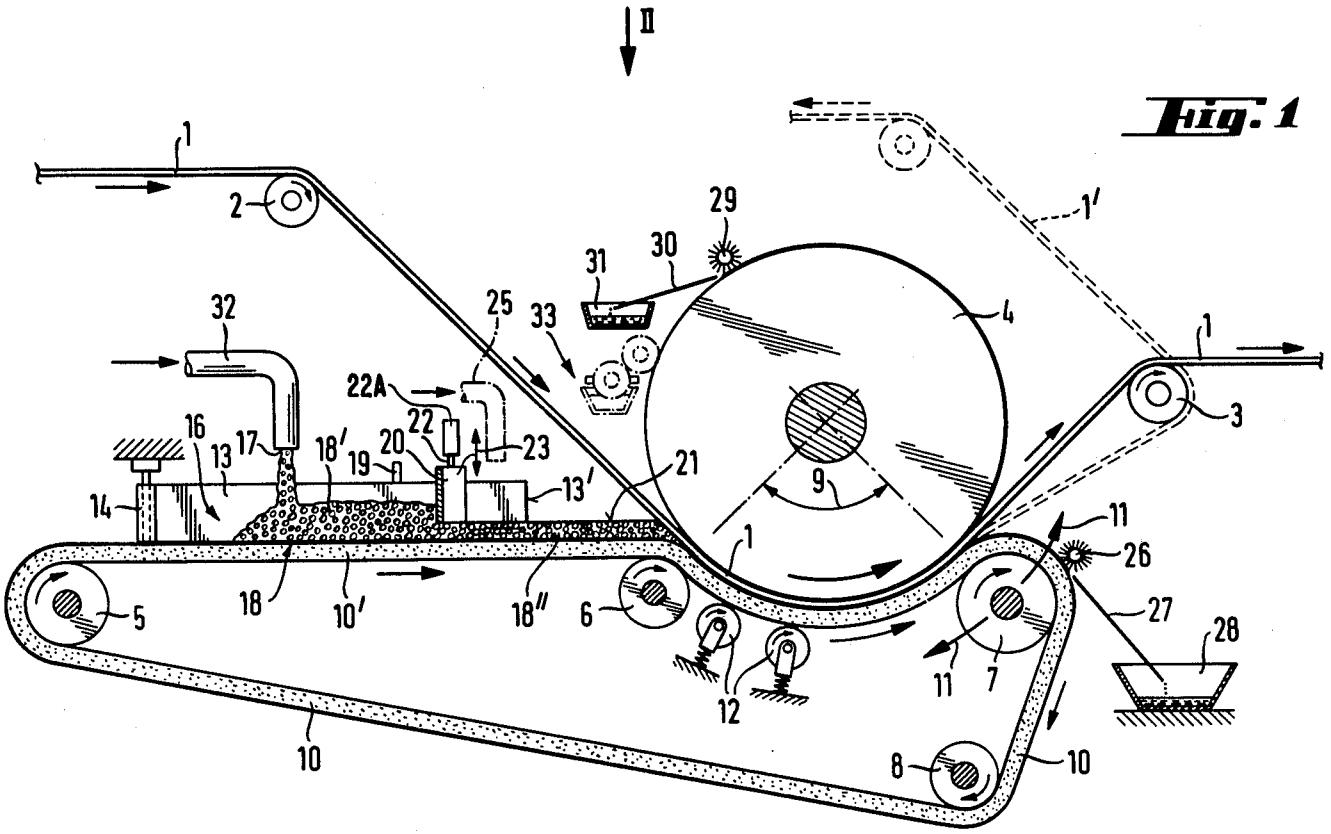

The width of fabric, which may comprise a width of carpet, is passed with the pile side down over the reversing rolls 2 and 3. Between the rolls 2 and 3, the carpet forms a drooping loop, at the bottom of which it is passed over a traversing or pressure roll 4 rotating in the direction of fabric travel as indicated by the arrows.

Under the fabric width 1, there is arranged an endless belt 10 running over a series of support rolls 5, 6, 7, 8 and made of a relatively thick and soft material withh a sealed surface, for example foam rubber. In the area wherein the width of fabric 1 turns around the pressure roll 4, the belt 10 rests against the fabric 1 from below and rotates in the same direction. The extent of the looping 9, wherein the belt 10 contacts the fabric 1 and the pressure roll 4, is determined by the position of support rolls 6 and 7, arranged with axles parallel to the axle of the pressure roll 4. These axles are spaced from the circumference of the roll 4 by a distance corresponding to the thickness of the belt 10 and the fabric. The support roll 7 may be pivoted for movement around the axis of the roll 4 in the direction indicated by the arrows 11, so that the extent of the looping range 9 may be adjusted as required.

Biased reinforcing rolls 12 are provided within the looping area 9 to increase the contact pressure of the belt 10 on the fabric 1 and the pressure roll 4, respectively.

Along an essentially horizontal section 10' of the belt 10 preceding the pressure roll 4 in the direction of motion, a plurality of partitions 13 are provided above the belt 10. These partitions extend essentially in the longitudinal direction of the belt, with the partitions 13 being bearingly supported at their ends opposite the direction of motion, in the manner shown by FIG. 2, in a pivoting manner. That is, the partitions may rotate about vertical axes defined by pins 14. The partitions 13 are in the form of narrow, flat plates or strips and are arranged directly over the belt 10. Close to the outer longitudinal edges of the fabric 1, a plurality of corresponding stationary partitions 15 are provided in order to laterally limit the area of application. Between the partitions 13, individual lanes 16 (FIG. 2) are formed, the total width of which represents the width of the area of application between the lateral partitions 15.

A feeder device with a feeder tube 32 for the foam is assigned to each of the lanes 16, with the outlet orifice of the tubes opening inside the individual lanes 16. By means of conventional devices, not shown, for the production of foam, different foams 18 may be introduced into the individual lanes 16 by means of the several foam supply tubes 32. The foams 18 are produced from a liquid containing dyes and provided with surface active substances.

The foams 18 are entrained by the rotating belt 10 according to the drawing from left to right. In a first zone 18', the surface of the foam, as seen in FIG. 1, is irregular. The transfer of such a layer of foam would result in irregular coloring.

In order to prevent this, doctor blades 20 are assigned to each individual lane 16. Those blades rake the surface of the foam contained in the lane down to a uniform height. Following the blades, there occur foam layers 18'' of uniform height.

The partitions, as mentioned hereinabove, are supported pivotingly and may be pivoted by means of adjusting devices acting upon lugs 19 of the partitions in a direction transverse to the fabric. The width of the lanes may thereby be varied at the rear ends 13' of the partitions, in the manner shown in FIG. 2. This in turn determines the width of the foam strips 21 transported on the belt 10.

With the belt 10 transporting the foam strips 21, the pile side of the fabric width 1 contacts the foam. In the process, the foam and the liquid forming it, respectively, are transferred to the pile side of the fabric 1. The time available for this is the period required by the fabric 1 to pass through the looping range 9. The foam stripe pattern formed on the belt 10 is transferred to the fabric 1 and is reproduced in the manner indicated on the righthand side of FIG. 2 on the width of fabric 1.

Figure 2:
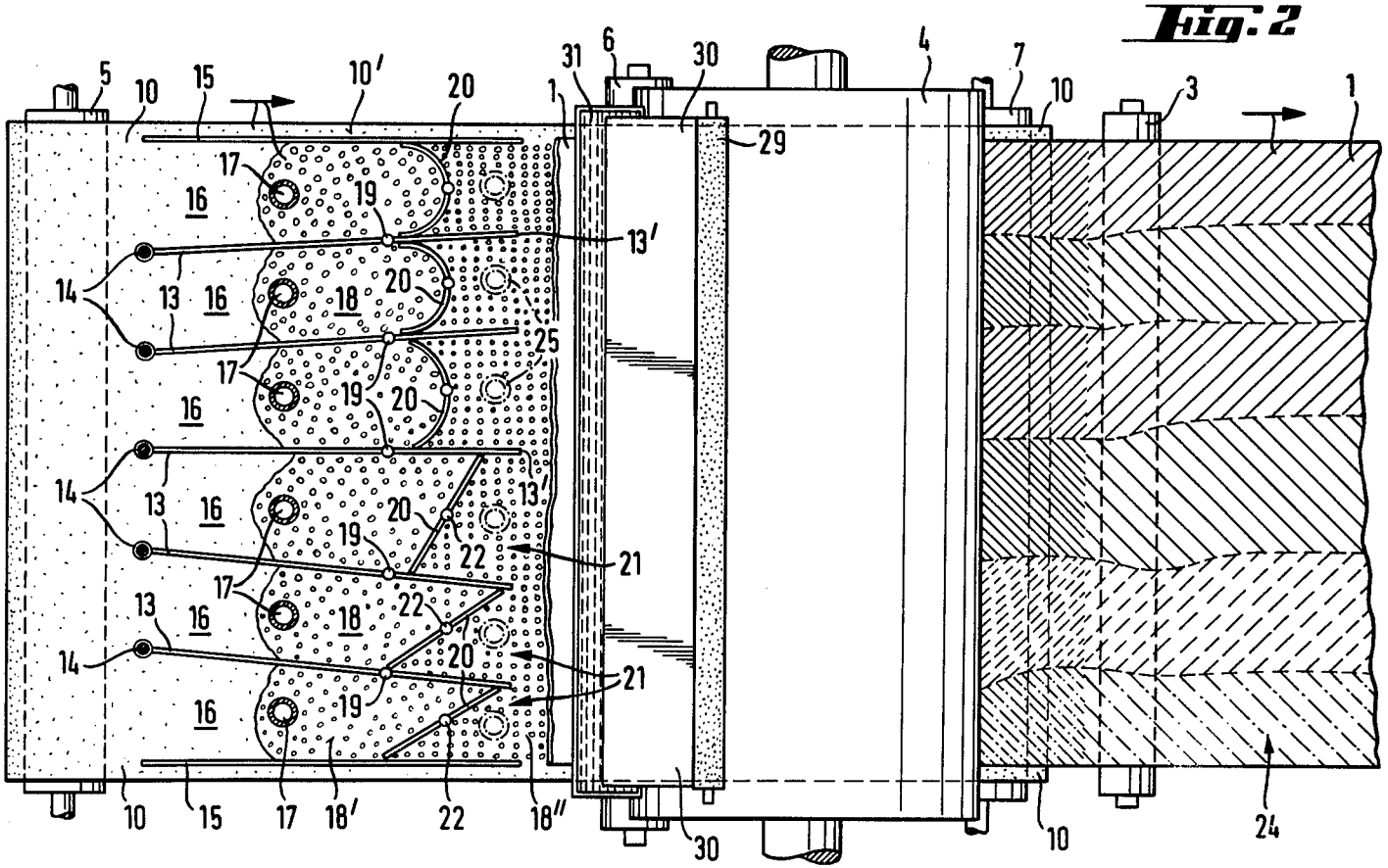

The doctor blades 20 always extend over the entire width of a lane 16. As this width is variable, the blades must be adjustable in their working width. One manner of effecting this is depicted in connection with three upper blades 20 in FIG. 2. Those blades are made of elastically flexible strips of sheet metal or synthetic plastic, the bending radius whereof varies in keeping with the existing width of the lanes 16. It is also possible, however, not to bend the blades 20, but rather to mount the blades for rotation about a central vertical axle 22 as depicted in connection with the three lower blades of FIG. 2. Thus, the latter three blades may be oriented more or less obliquely in the lanes 16. The height to which the blades 20 are raking the foam strips 18'' may be varied in a controlled manner, by raising and lowering the blades, e.g., by moving the axles 22 up and down in the direction of arrow 23 by any suitable raising devices **22*a* (FIG. 1). The movement takes place between (1) a maximum height and (2) a zero height at which no foam is passed to the right. If the passage height of the blades 20 is varied during the passing of the fabric width 1, there is obtaind within the pattern stripes corresponding to the lanes 16, a pattern in the longitudinal direction in the form of different depths of shades, as indicated in FIG. 2 by means of shading of different density, for example at 24**.

Patterns may be varied further by means of feeder devices 25 arranged downstream of the blades 20 for additional dyes in the form of a foam, a liquid, a powder or the like.

In order to prevent interference with the pattern on the width of fabric 1 by dye material carried by the belt 10 following separation of the fabric from the belt, the belt is cleaned at a subsequent location by means of a roller brush 26 and a doctor blade 27, which removes any patterning material that is still adhering and deposits same into a trough 28. In a similar manner, the reversing roll 4, which may be contaminated by dye materal penetrating through the fabric 1, is cleaned by a roller brush 29 and a blade 30 which operate in a collector trough 31.

If the fabric 1 comprises a pile fabric and is carried around the reversing roll 4 with its pile side facing the foam, the fabric path indicated by the broken line and designated by 1' in FIG. 1 may be chosen, in place of the path indicated by the solid line; with the fabric being passed with its reverse side over the reversing roll 3. In the manner, the foam is able to penetrate without resistance into the pile. It may further be desirable in such a case to let the width of fabric 1 pass over a longer path following the application of the foam, prior to guiding it into the steamer, so that the foam may have an opportunity to thoroughly penetrate the pile.

FIG. 1 shows additionally by a broken line an application mechanism 33, whereby an agent for promoting the disintegration of the foam may be applied to the surface of the pressure roll 4, across its width. During the rotation of the pressure roll 4 in the direction indicated, the surface layer of the agent is applied to the reverse side of the width of fabric 1 facing away from the application of the foam. The agent penetrates into the fabric and effects the disintegration of the foam from the inside of the fabric 1. It is evident that this process presupposes a suitably permeable width of fabric 1.

By applying the agent in this fashion, the textile is dyed more uniformly in the direction of its depth that is, the foam contacts the disintegration agent progressively as it seeps down into the pile, and thus the liquid dye is not released all at once at the surface of the pile.

Although the invention has been described in connection with a preferred embodiment thereof, it will be appreciated by those skilled in the art that modifications, additions, substitutions, and deletions may be made without departing from the spirit and scope of the invention as defined in the appended claims.

What is claimed is:

1. Apparatus for forming patterns on a substrate, comprising:

a flat support movable longitudinally, a plurality of laterally spaced partitions extending generally longitudinally and forming a plurality of laterally adjacent, longitudinally extending lanes on said support, means for moving said support longitudinally past said partitions, means for introducing dye-containing foams into said lanes and onto said support to form longitudinal lanes of foam on said support, a plurality of height-regulating means for selectively regulating the heights of foam independently in each of said lanes, means for moving the substrate longitudinally into engagement with the lanes of foam such that the latter are transferred onto the substrate to form longitudinal patterns thereon, and means for actuating said height-regulating means independently on one another during movement of the support to longitudinally vary the foam lane height and thereby longitudinally vary the resulting pattern formed on the substrate.

2. Apparatus according to claim 1 including means for laterally adjusting at least portions of said partitions as said support travels therepast, and without lifting said partitions relative to said support, to vary the foam lane widths formed by said partitions.

3. Apparatus according to claim 2 including means mounting upstream ends of said partitions for pivotal movement about axes disposed perpendicularly relative to said support so that the lateral spacing between downstream ends of said partitions can be varied.

4. Apparatus according to claim 2, wherein said height-regulating means comprises a plurality of doctor blades, each doctor blade extending between adjacent partitions, each doctor blade being movable to conform to the spacing between the associated portions and being movable toward and away from said support to vary the foam lane height.

5. Apparatus according to claim 4, wherein each blade is flexible so as to be bendable in a manner varying its effective width.

6. Apparatus according to claim 5, wherein upstream ends of said blades are rotatable about axes extending perpendicular to said support to enable the lateral spacing between downstream ends of said blades to be varied.

7. Apparatus according to claim 1 including means for introducing additional substances into said lanes downstream of said height-regulating means.

8. Apparatus according to claim 1, wherein said support is arranged to be moved into merging relationship with the substrate downstream of the place where the foam is introduced into said lanes.

9. Apparatus according to claim 8, wherein said support comprises a belt arranged to travel in converging relationship with the substrate.

10. Apparatus according to claim 9 including a traversing roll, the substrate being sandwiched between said roll and the belt, a curved portion of said belt which travels around said roll dipping beneath the plane of an upstream portion of the belt to which the lanes of foam are applied.

11. Apparatus according to claim 10, including support rollers disposed beneath upstream and downstream ends of said curved portion of the belt for supporting said belt, at least one of said support rollers being adjustable to vary the extent of said curved portion.

12. Apparatus according to claim 10, including means for applying to the periphery of said roll an agent promoting disintegration of the foam, to be transferred to a side of the substrate opposite the side to which the foam is applied.

13. Apparatus according to claim 9, wherein, said belt comprises a soft, thick-walled material having a sealed surface.

14. Apparatus according to claim 13, including a plurality of pressure rolls pressing said belt toward said traversing roll.

15. Apparatus for forming patterns on a textile, comprising:

a flat support movable longitudinally, a plurality of laterally spaced partitions extending generally longitudinally and forming a plurality of laterally adjacent, longitudinally extending lanes on said support, means for moving said support longitudinally past said partitions, means for introducing dye-containing foams into said lanes and onto said support to form longitudinal lanes of foam on said support, a plurality of height-regulating means for selectively regulating the heights of foam independently in each of said lanes, means for moving the textile longitudinally to engage with the lanes of foam to transfer the lanes of foam onto the textile to form longitudinal patterns thereon, and means for actuating said height-regulating means indpendently of one another during movement of the support, to longitudinally vary the foam lane height and thereby longitudinally vary the resulting pattern form on the textile.

16. Apparatus according to claim 15 including means for laterally adjusting at least portions of said partitions as said support travels therepast, and without lifting said partitions relative to said support, to vary the foam lane widths formed by said partitions.

17. Apparatus according to claim 16 including means mounting upstream ends of said partitions for pivotal movement about axes disposed perpendicularly relative to said support so that the lateral spacing between downstream ends of said partitions can be varied.

18. Apparatus according to claim 16 wherein said height-regulating means comprises a plurality of doctor blades, each doctor blade extendinb etween adjacent partitions, each doctor blade being movable to conform to the spacing between the associated portions and being movable toward and away from said support to vary the foam lane height.

19. Apparatus according to claim 18, wherein each blade is flexible so as to be bendable in a manner varying its effective width.

20. Apparatus according to claim 19, wherein upstream ends of said blades are rotatable about axes extending perpendicular to said support to enable the lateral spacing between downstream ends of said blades to be varied.

21. Apparatus according to claim 15, including means for introducing additional substances into said lanes downstream of said height-regulating means.

22. Apparatus according to claim 15, wherein said support is arranged to be moved into merging relationship with the textile downstream of the place where the foam is introduced into said lanes.

23. Apparatus according to claim 22, wherein said support comprises a belt arranged to travel in converging relationship with the textile.

24. Apparatus according to claim 23 including a traversing roll, the substrate being sandwiched between said roll and the belt, a curved portion of said belt which travels around said roll dipping beneath the plane of an upstream portion of the belt to which the lanes of foam are applied.

25. Apparatus according to claim 24 including support rollers disposed beneath upstream and downstream ends of said curved portion of the belt for supporting said belt, at least one of said support rollers being adjustable to vary the extent of said curved portion.

26. Apparatus according to claim 24 including means for applying to the periphery of said roll an agent promoting disintegration of the foam, to be transferred to a side of the textile opposite the side to which the foam is applied.

27. Apparatus according to claim 23, wherein said belt comprises a soft, thick-walled material having a sealed surface.

28. Apparatus according to claim 27 including a plurality of pressure rolls pressing said belt toward said traversing roll.

29. Apparatus for applying patterns to a substrate, comprising:

a flat belt movable longitudinally, a plurality of laterally spaced partitions extending in a longitudinal direction over said belt and forming a plurality of laterally adjacent lanes extending in said longitudinal direction, said portions being adjustable to vary the widths of the downstream ends of said lanes, means for introducing dye-containing foams into said lanes, means for regulating the heights of foam in said lanes, means for moving the substrate in said longitudinal direction and into engagement with the lanes of foam to transfer the foam to the substrate, a traversing roll arranged such that the substrate is sandwiched between said roll and said belt, the curved portion of said belt traveling around said roll dipping beneath the plane of that portion of the belt to which the lanes of foam are applied, and means for applying to the periphery of said roll an agent promoting disintegration of the foam to be transferred to a side of the substrate opposite the side thereof to which the foam is applied.

30. Apparatus according to claim 29, wherein said substrate is a textile.

* * * * *